US009954303B2

(12) United States Patent
Guo et al.

(10) Patent No.: US 9,954,303 B2
(45) Date of Patent: Apr. 24, 2018

(54) WATERPROOF ELECTRICAL CONNECTOR ASSEMBLY

(71) Applicant: FOXCONN INTERCONNECT TECHNOLOGY LIMITED, Grand Cayman (KY)

(72) Inventors: Jing-Jie Guo, HuaiAn (CN); Jun Zhao, HuaiAn (CN); Cai-Yun Zhang, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/406,662

(22) Filed: Jan. 13, 2017

(65) Prior Publication Data

US 2017/0207570 A1 Jul. 20, 2017

(30) Foreign Application Priority Data

Jan. 14, 2016 (CN) ..... 2016 1 0022832

(51) Int. Cl.

| | |
|---|---|
| ***H01R 13/52*** | (2006.01) |
| ***H01R 13/6585*** | (2011.01) |
| ***H01R 12/72*** | (2011.01) |
| *H01R 24/00* | (2011.01) |
| *H01R 13/648* | (2006.01) |
| *H01R 13/6581* | (2011.01) |
| *H01R 33/965* | (2006.01) |

(52) U.S. Cl.

CPC ..... *H01R 13/5216* (2013.01); *H01R 12/722* (2013.01); *H01R 13/6585* (2013.01); *H01R 13/5202* (2013.01); *H01R 13/648* (2013.01); *H01R 13/6581* (2013.01); *H01R 23/02* (2013.01); *H01R 33/965* (2013.01)

(58) Field of Classification Search

CPC .. H01R 13/648; H01R 13/6581; H01R 23/02; H01R 13/6466; H01R 24/64; H01R 13/6587; H01R 23/6873; H01R 23/7073; H01R 13/52; H01R 33/965

USPC ..... 439/660, 676, 607.01, 607.4, 271, 587

See application file for complete search history.

(56) References Cited

U.S. PATENT DOCUMENTS 8,388,380 B1 * 3/2013 Van der Steen ... H01R 13/5202 439/607.36

9,444,177 B2 9/2016 Tsai et al.

(Continued)

FOREIGN PATENT DOCUMENTS

CN 204216260 3/2015

*Primary Examiner* — Abdullah Riyami
*Assistant Examiner* — Justin Kratt
(74) *Attorney, Agent, or Firm* — Wei Te Chung; Ming Chieh Chang

(57) ABSTRACT

An electrical connector assembly includes an electrical connector and an outer cover over-molding the electrical connector. The electrical connector include: an insulative housing having a base, a front tongue, and a rear extension; an upper and lower rows of contacts mounted in the insulative housing and exposed to the tongue, each of the upper and lower rows of contacts having a tail; a metallic plate positioned between the upper and lower rows of contacts; and a shielding shell enclosing the insulative housing. The outer cover is over-molded with the shielding shell to seal a rear of the electrical connector while exposing the rear extension of the insulative housing and the tails of the contacts.

19 Claims, 14 Drawing Sheets

(56) References Cited

U.S. PATENT DOCUMENTS

| | | | | |
|---|---|---|---|---|
| 2002/0119697 | A1 | 8/2002 | Chan | |
| 2012/0315779 | A1 | 12/2012 | Yudate et al. | |
| 2013/0183844 | A1* | 7/2013 | Wang | H01R 24/68 439/271 |
| 2015/0244099 | A1 | 8/2015 | Lee | |
| 2016/0104957 | A1* | 4/2016 | Kim | H01R 13/6581 439/78 |
| 2016/0111821 | A1 | 4/2016 | Lan et al. | |
| 2016/0181723 | A1* | 6/2016 | Tsai | H01R 13/5202 439/587 |
| 2016/0268722 | A1* | 9/2016 | Tsai | H01R 13/5202 |

* cited by examiner

WATERPROOF ELECTRICAL CONNECTOR ASSEMBLY

BACKGROUND OF THE INVENTION

1. Field of the Invention

The present invention relates to a waterproof electrical connector having an outer over-molded cover.

2. Description of Related Arts

China Patent No. 204216260, issued on Mar. 18, 2015, discloses an electrical connector including an inner insulative housing, a shielding shell enclosing the inner insulative housing, and an outer overmold enclosing the shielding shell. The electrical connector further includes a sealing member between the shielding shell and the outer overmold. Additional sealing member and/or sealing cover may be provided at a rear of the outer overmold.

U.S. Patent Application Publication No. 2016/0104957, published on Apr. 14, 2016, discloses a connector assembly including a housing in a form of a seamless tube, a terminal portion disposed inside the housing, and a cover shell. A potting portion is formed at a rear of the terminal portion to seal the rear of the terminal portion and the housing for waterproofing. The potting portion is formed by filling resin in the rear of the terminal portion from a rear of the housing after assembling the terminal portion and the housing.

SUMMARY OF THE INVENTION

An electrical connector assembly comprises an electrical connector of coplanar design and an outer over-molded cover of waterproof function. The electrical connector includes: an insulative housing having a base, a front tongue, and a rear extension; an upper and lower rows of contacts mounted in the insulative housing and exposed to the tongue, each of the upper and lower rows of contacts having a tail; a metallic plate positioned between the upper and lower rows of contacts; and a shielding shell enclosing the insulative housing. The outer cover is over-molded with the shielding shell to seal a rear of the electrical connector while exposing the rear extension of the insulative housing and the tails of the contacts.

DETAILED DESCRIPTION OF THE PREFERRED EMBODIMENT

Figure 1:
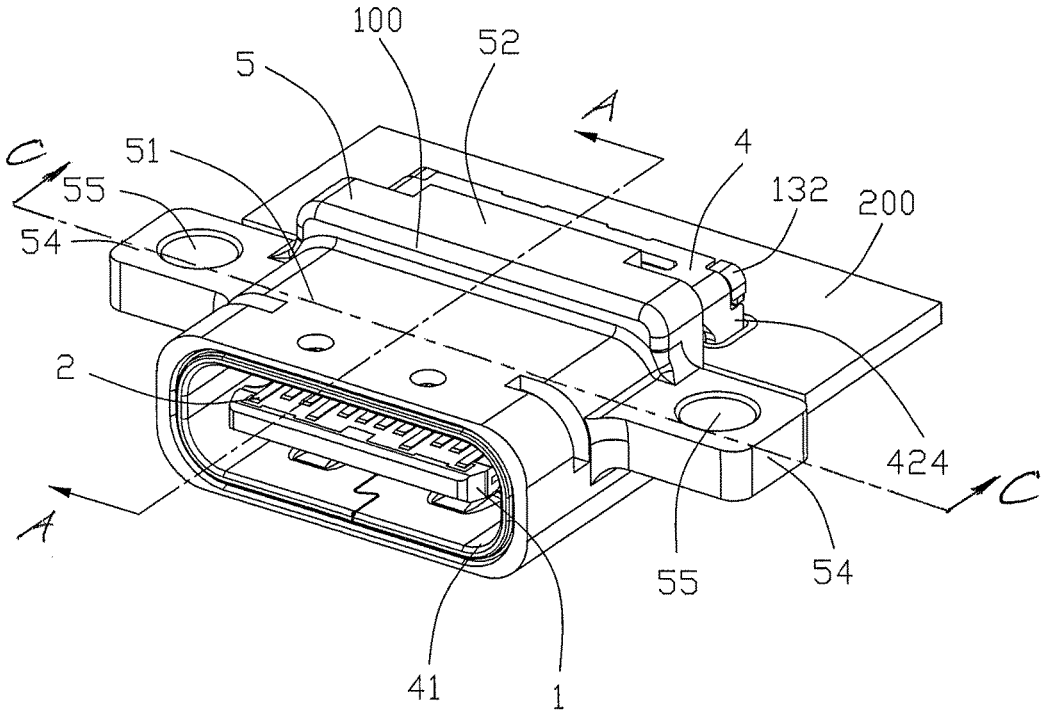
FIG. 1 is a perspective view of an electrical connector assembly in accordance with the present invention mounted to a printed circuit board.

Referring to FIGS. 1 to 10, an electrical connector assembly 100 to be mounted on a printed circuit board (PCB) 200 comprises an electrical connector 10 and an outer cover 5. The electrical connector 10 includes an insulative housing 1, an upper and lower rows of contacts 2 mounted in the insulative housing 1, a metallic plate 3 positioned between the upper and lower rows of contacts 2, and a shielding shell 4 enclosing the insulative housing 1.

Figure 7:
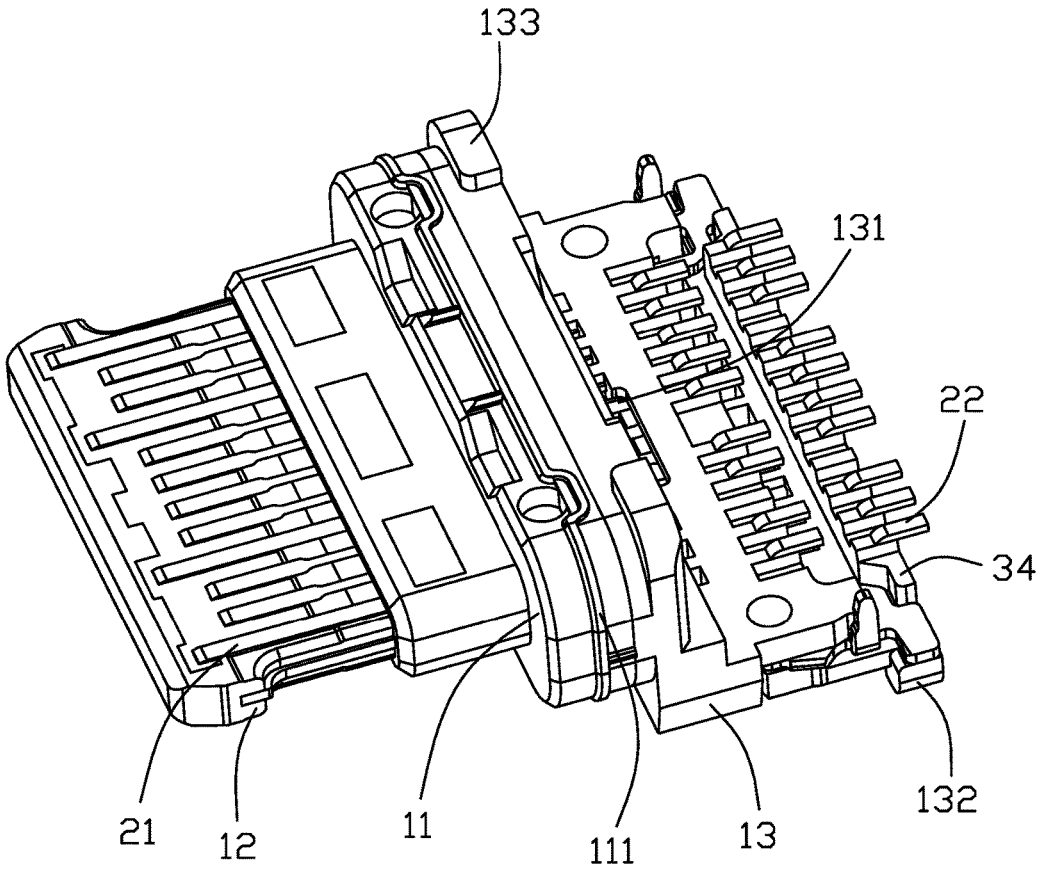
FIG. 7 is another perspective view of the electrical connector in FIG. 6.
Figure 8:
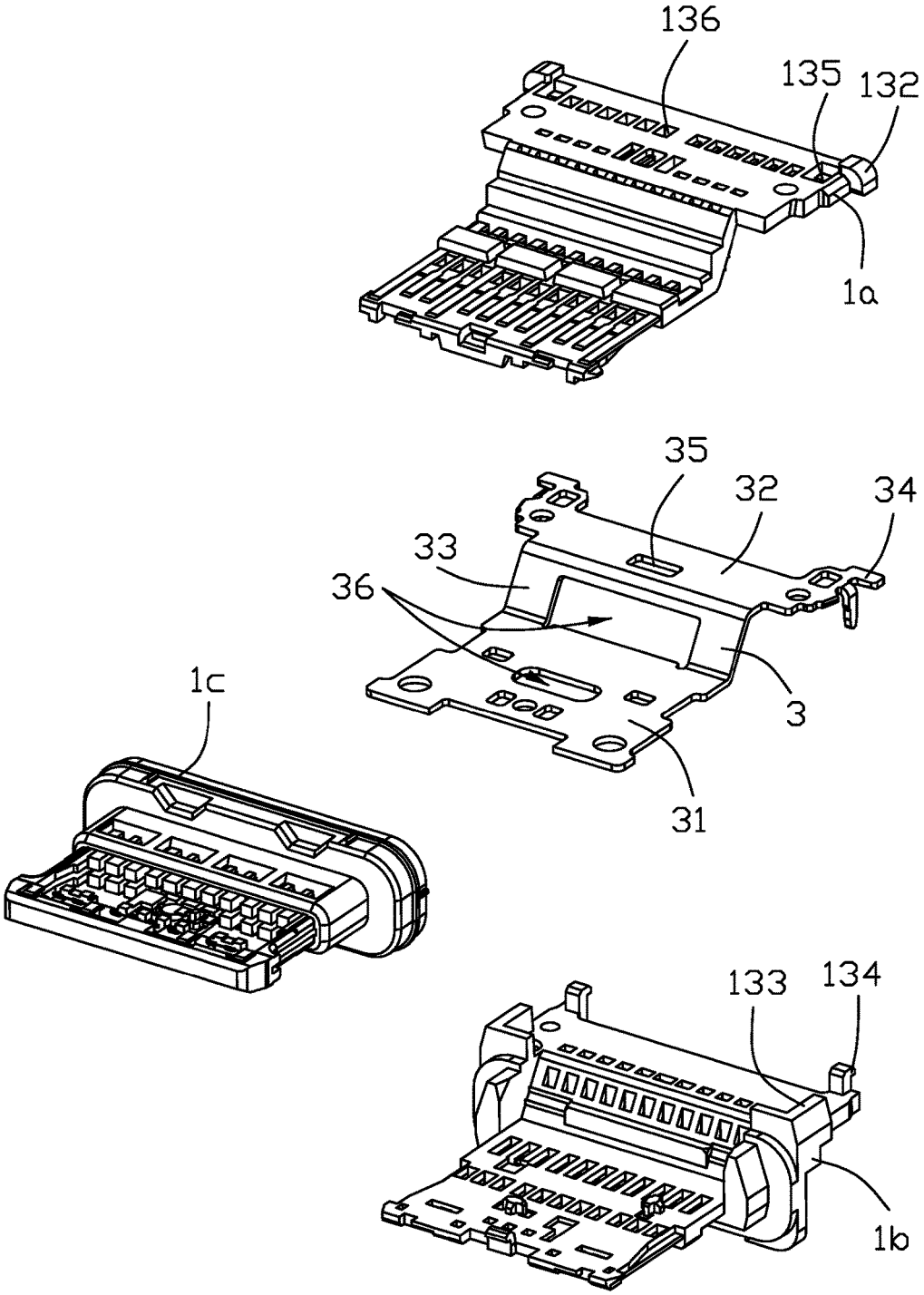
FIG. 8 is an exploded perspective view of the terminal module of the electrical connector in FIG. 6.
Figure 9:
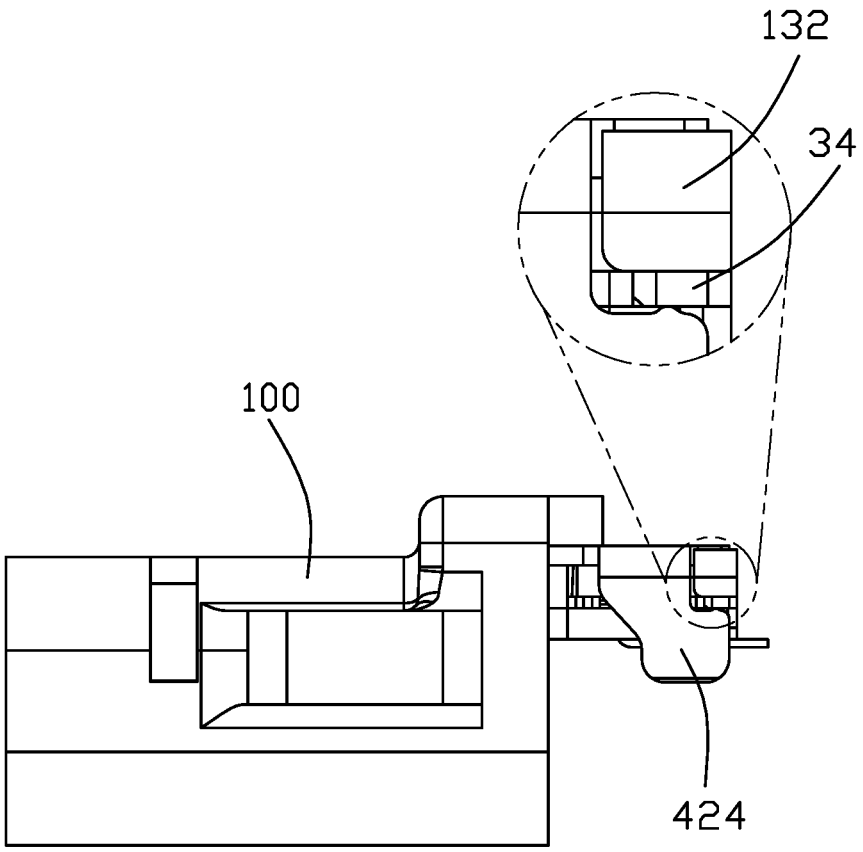
FIG. 9 gives an enlarged view of a circled portion showing an engagement structure of the electrical connector.
Figure 10:
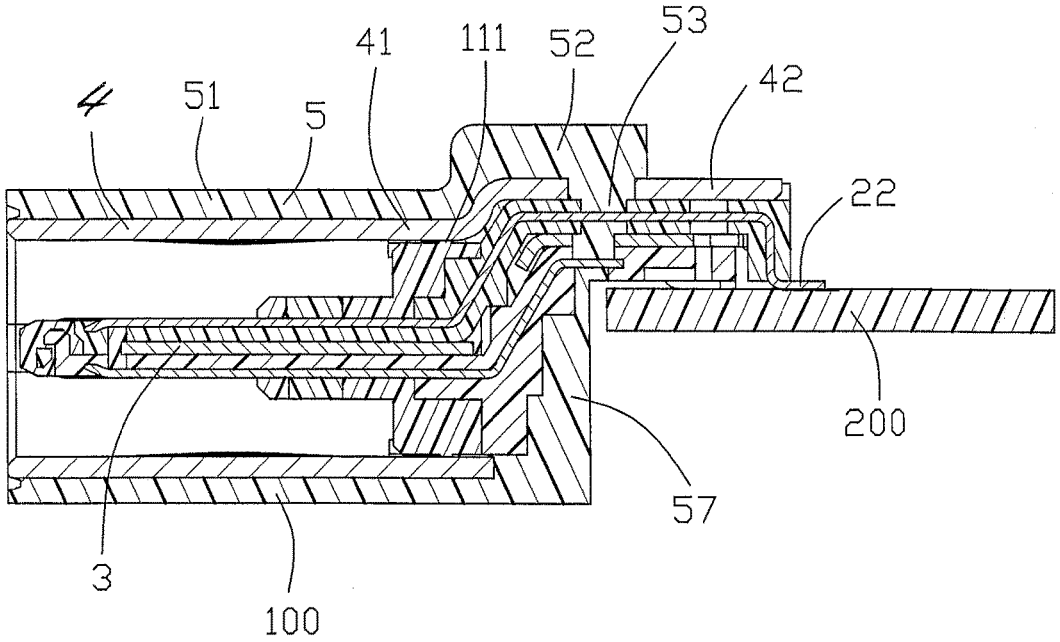
FIG. 10 is a cross-sectional view of the electrical connector assembly taken along line A-A in FIG. 1.
Figure 11:
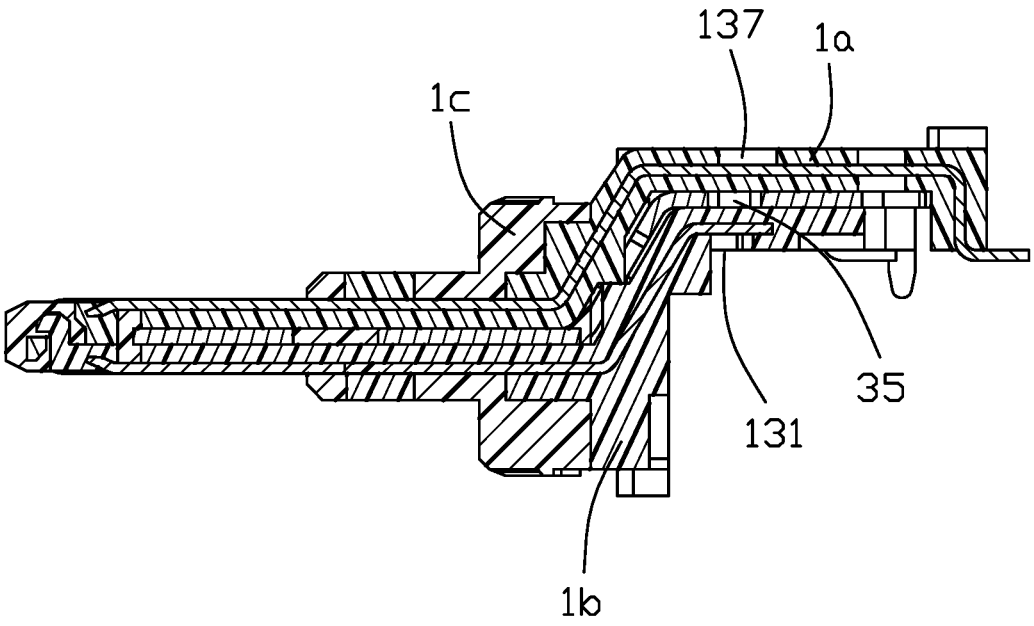
FIG. 11 is a cross-sectional view of the terminal module taken along line B-B in FIG. 6.
Figure 12:
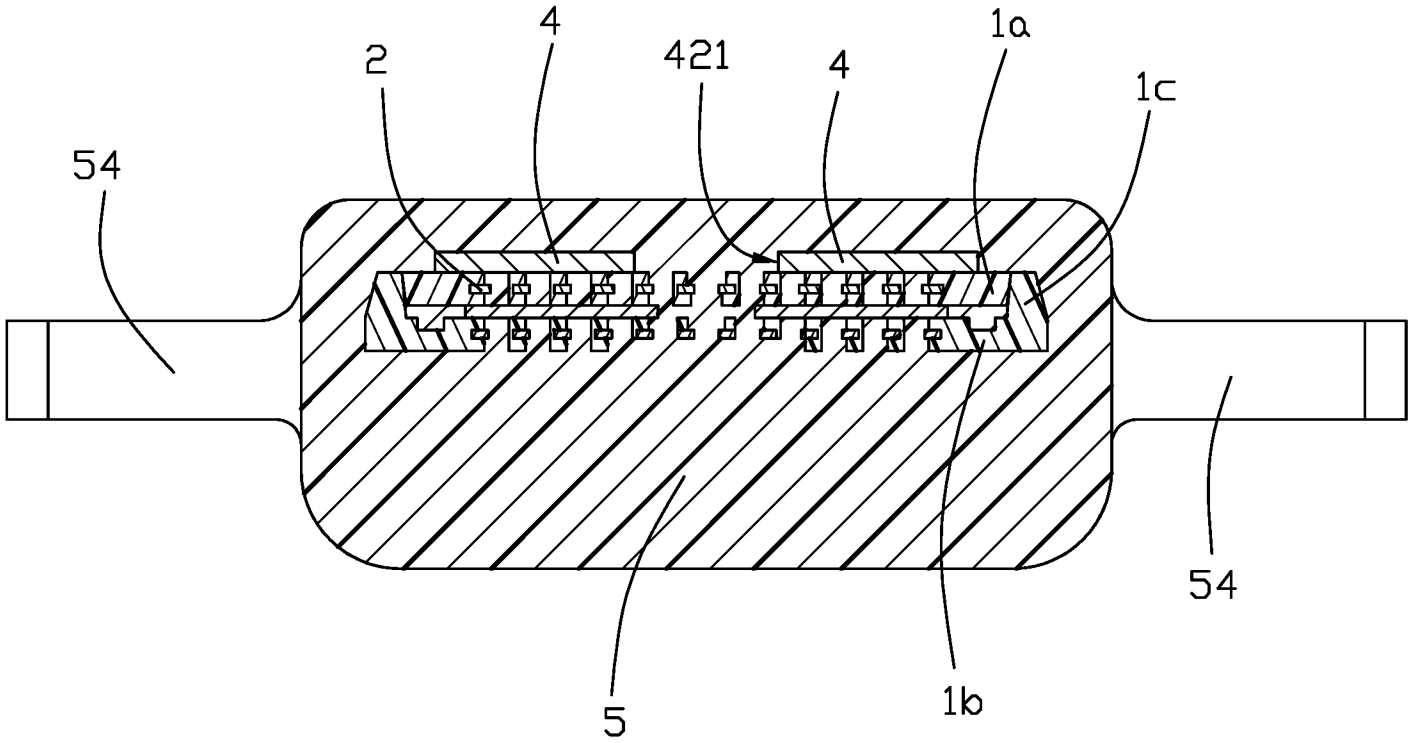
FIG. 12 is a cross-sectional view of the terminal module taken along line C-C in FIG. 1 without the PCB thereof.
Figure 13:
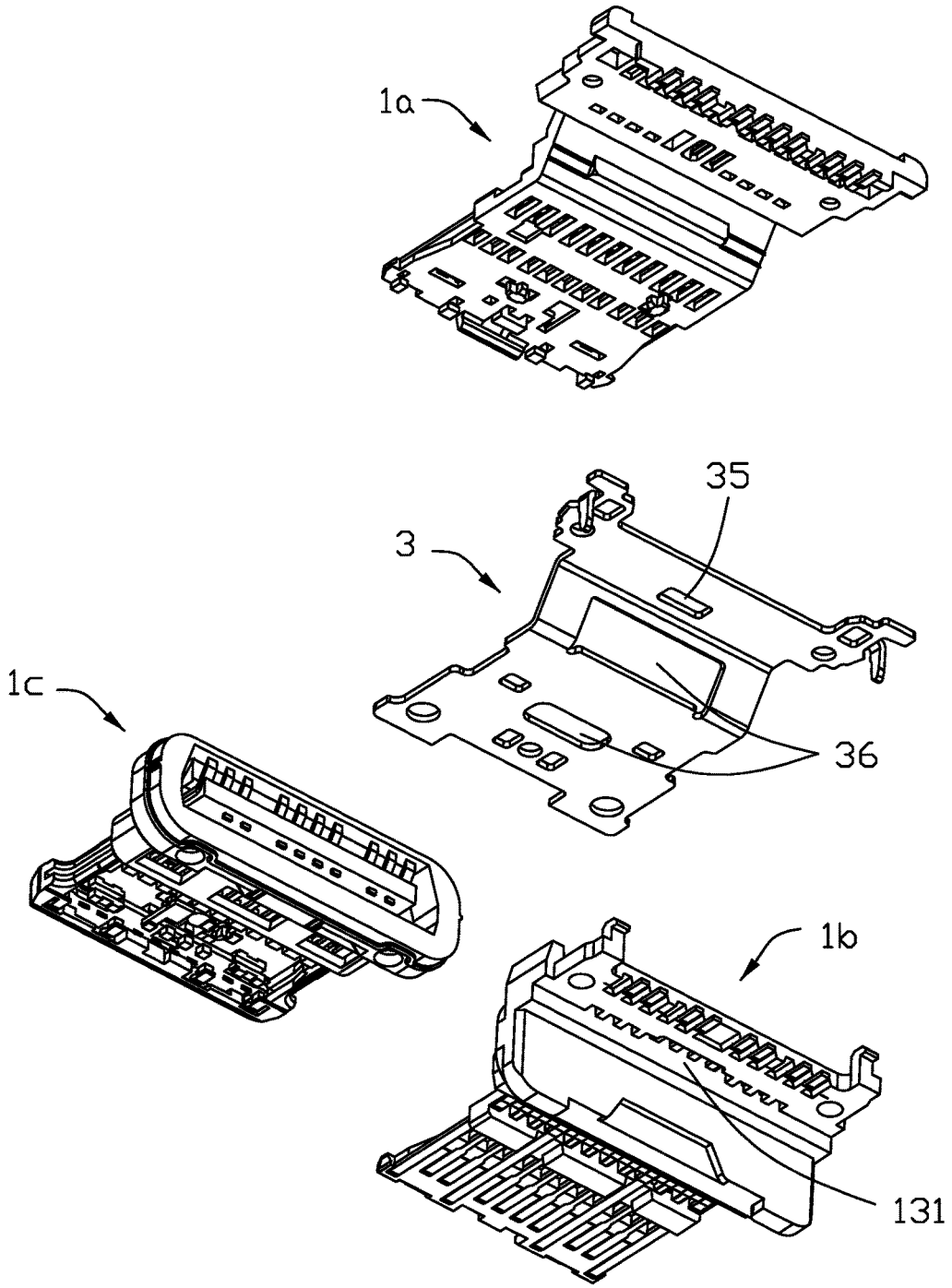
FIG. 13 is another explode perspective view of the terminal module of the electrical connector of FIG. 8.

As shown in FIG. 8, the insulative housing 1 includes an upper body 1*a* and a lower body 1*b*. The upper and lower rows of contacts 2 are secured to the upper and lower bodies 1*a* and 1*b*, respectively. The insulative housing 1 is formed by further insert molding a final body 1*c* with the upper and lower bodies 1*a* and 1*b* so as to form a terminal module (not labeled) totally. Also referring to FIGS. 6 and 7, the insulative housing 1 has a base 11, a front tongue 12, and a rear extension 13. The base 11 includes a peripheral ridge 111. The rear extension 13 includes a pair of corner portions 132 at an upper rear part of the upper body 1*a* and four stopping blocks 133 at the lower body 1*b* and proximal to the base 11. The upper body 1*a* further has a pair of slots 135 and the lower body 1*b* further has a pair of hooks 134 for locking to the slots 135. A potting hole 131 is provided on the rear extension 13 as is seen in FIG. 7. The upper body 1*a* further includes a plurality of through (inspection) holes 136 in vertical alignment with the solder tails of the corresponding lower row of contacts 2, respectively, so as to allow the operator to inspect the mounting status of the solder tails of the lower row of contacts 2 on the printed circuit board 200.

Each of the upper and lower rows of contacts 2 includes a contact portion 21 and a tail 22.

The metallic plate 3 includes a front (lower) portion 31, a rear (upper) portion 32, and an intermediate connecting portion 33. The upper portion 32 has a potting hole 35 and a pair of wing portions 34 immediately below the pair of corner portions 132 in an assembled insulative housing 1. A plurality of openings 36 are formed in metallic plate 3 in which the final body 1*c* is received.

Figure 4:
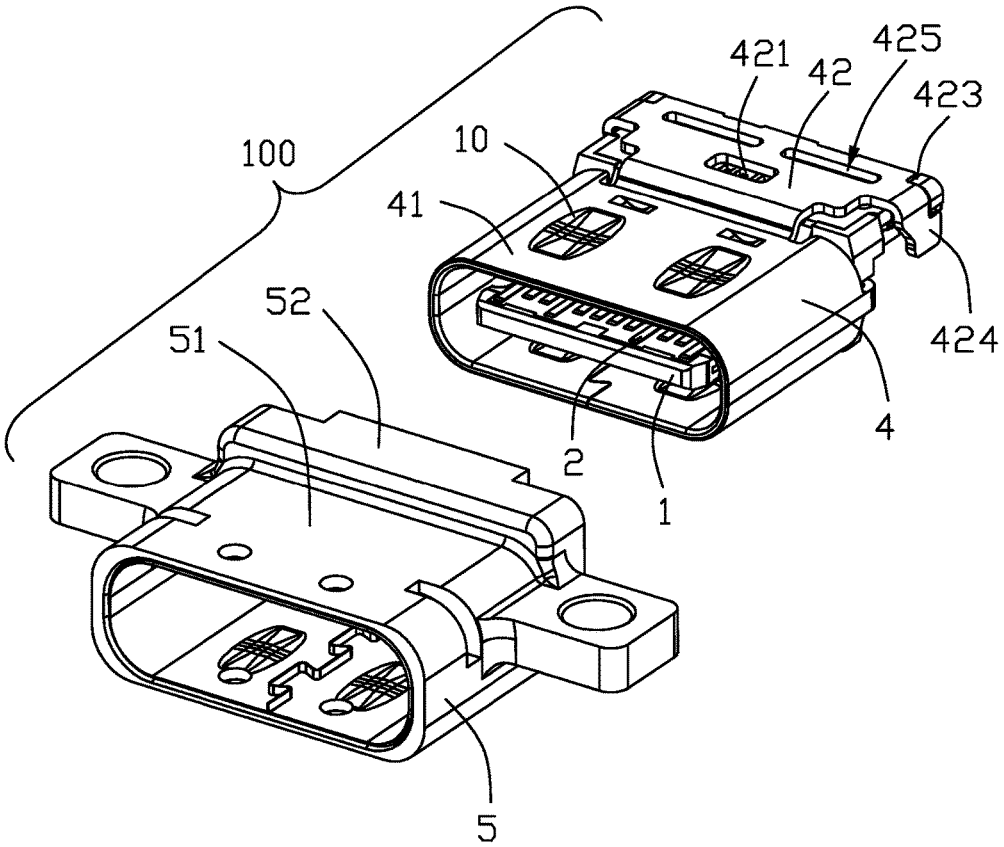
FIG. 4 is an exploded view of the electrical connector assembly.
Figure 5:
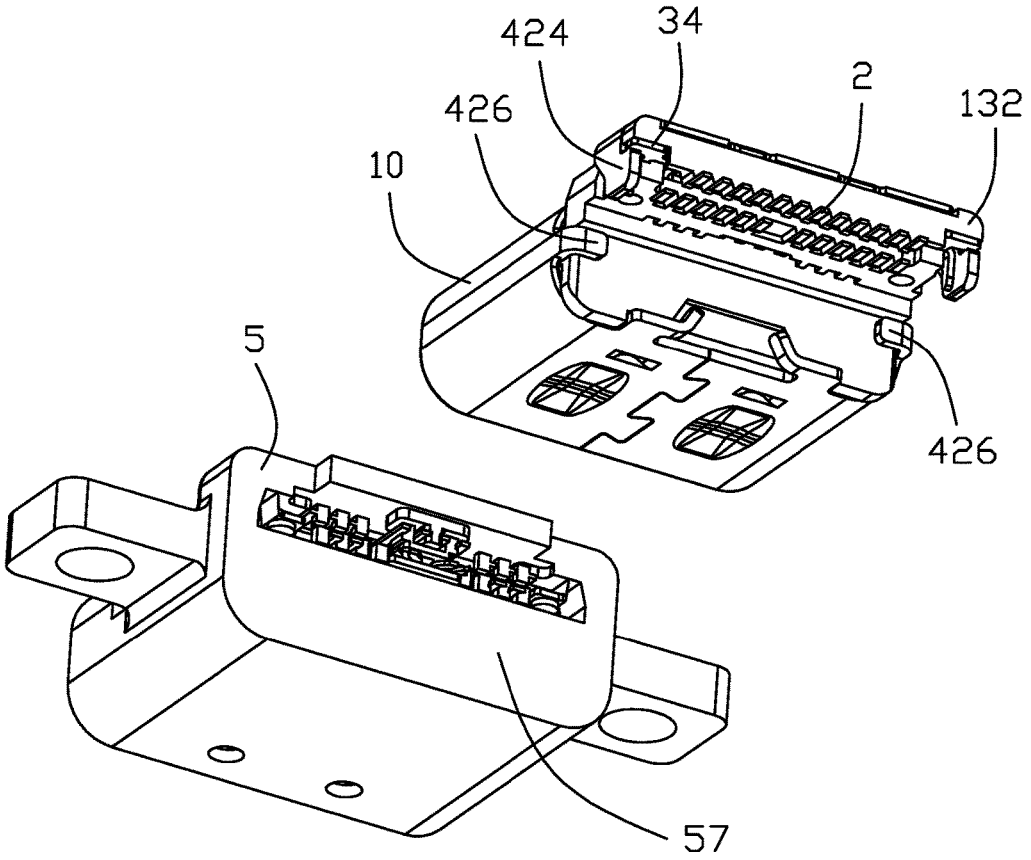
FIG. 5 is another exploded view of the electrical connector assembly.
Figure 6:
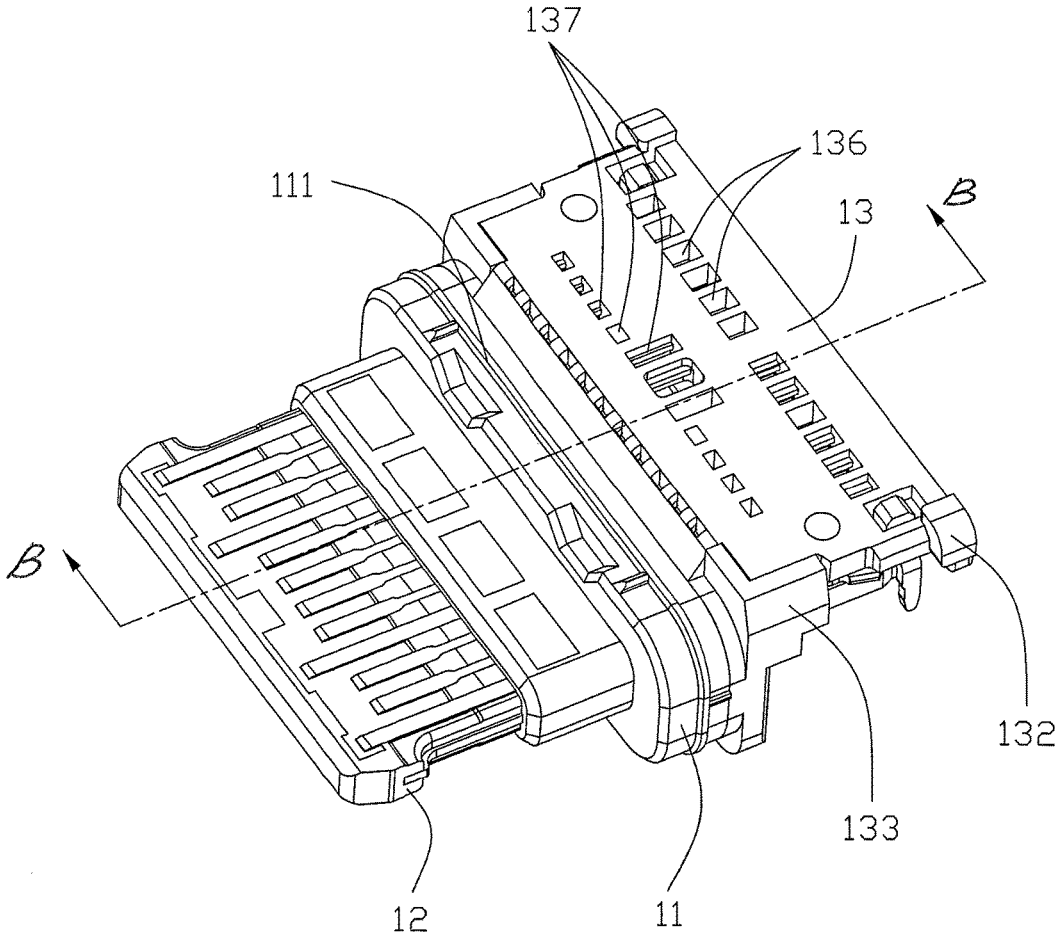
FIG. 6 is a perspective view of the terminal module of an electrical connector of the electrical connector assembly without a shielding shell thereof.

As shown in FIG. 4, the shielding shell 4 has a fat tubular main body 41 and an extension 42 connected to an upper edge of the main body 41. The extension 42 has a potting hole 421, a pair of notches 423 receiving the pair of corner portions 132, and a pair of mounting portions 424 bearing against the pair of wing portions 34. The shielding shell 4 further includes a pair of through (inspection) slots 425 in vertical alignment with the through (inspection) holes 136 for allowing the operator to inspect the status of the solder tails of the lower row of contacts 2 on the printed circuit board 200. In this embodiment, the main body 41 defines a mating cavity (not labeled) in which the front tongue 12 forwardly extends.

The outer cover 5 has a front part 51, a rear part 52, and a fixing portion 53 (FIG. 10) inside the rear part 52. The fixing portion 53 is a potting portion formed by filling resin through and in the hole 421, the hole 35, and the hole 131 that are in fluid communication with one another. In this embodiment, the cover 5 further includes a pair of mounting ears 54 on two lateral sides each equipped with a mounting hole 55 therein for attaching the electrical connector 10 to an exterior part (not shown). Notably, in this embodiment, the mounting ears 54 and the solder tails of the contacts 2 are located at different levels in the vertical direction.

The upper and lower rows of contacts 2 are respectively insert molded with the upper and lower bodies 1*a* and 1*b* and then the metallic plate 3 positioned therebetween is further insert molded with the final body 1*c* to be totally a terminal module in a generally known manner to expose the contact portions 21 to the tongue 12. The electrical connector 10 is completed by mounting the shielding shell 4 to enclose the insulative housing 1.

In the above structure of the electrical connector 10, the hooks 134 are locked to the slots 135, the tails 22 of the contacts 2 are arranged at the bottom of the rear extension 13 of the insulative housing 1, the extension 42 of the shielding shell 4 covers an upper of the rear extension 13, the corner portions 132 are received in the notches 423, the wing portions 34 of the metallic plate 3 are clamped between the corner portions 132 and the mounting portions 424. Moreover, the peripheral ridge 111 is interference fit with the shielding shell 4 and the stopping blocks 133 abut against the shielding shell 4.

Figure 2:
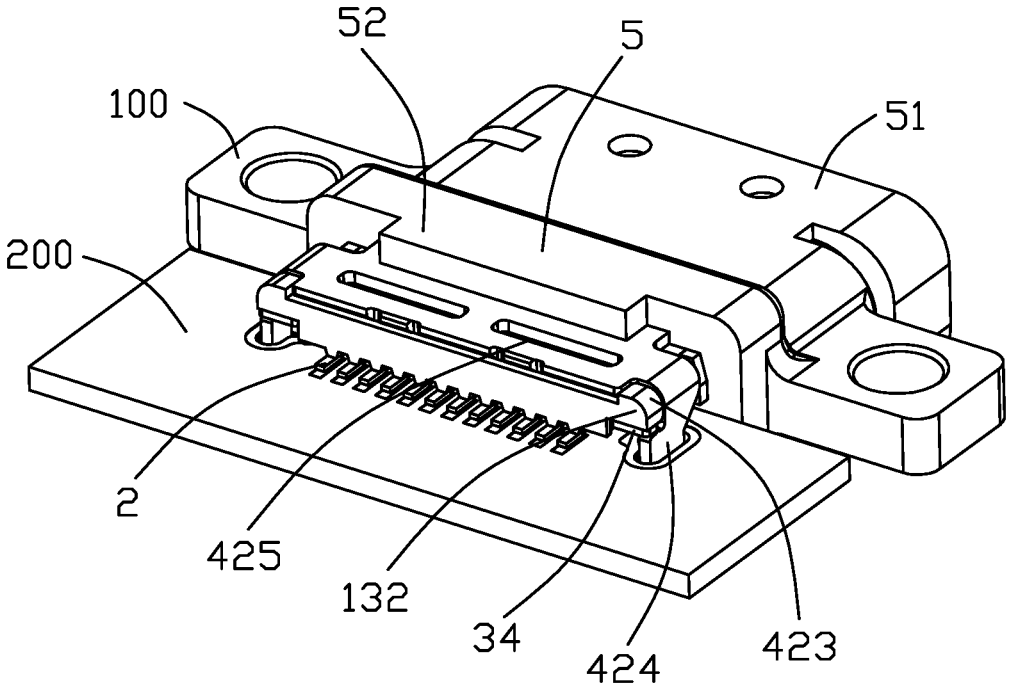
FIG. 2 is a further perspective view of the electrical connector assembly mounted to the printed circuit board.
Figure 3:
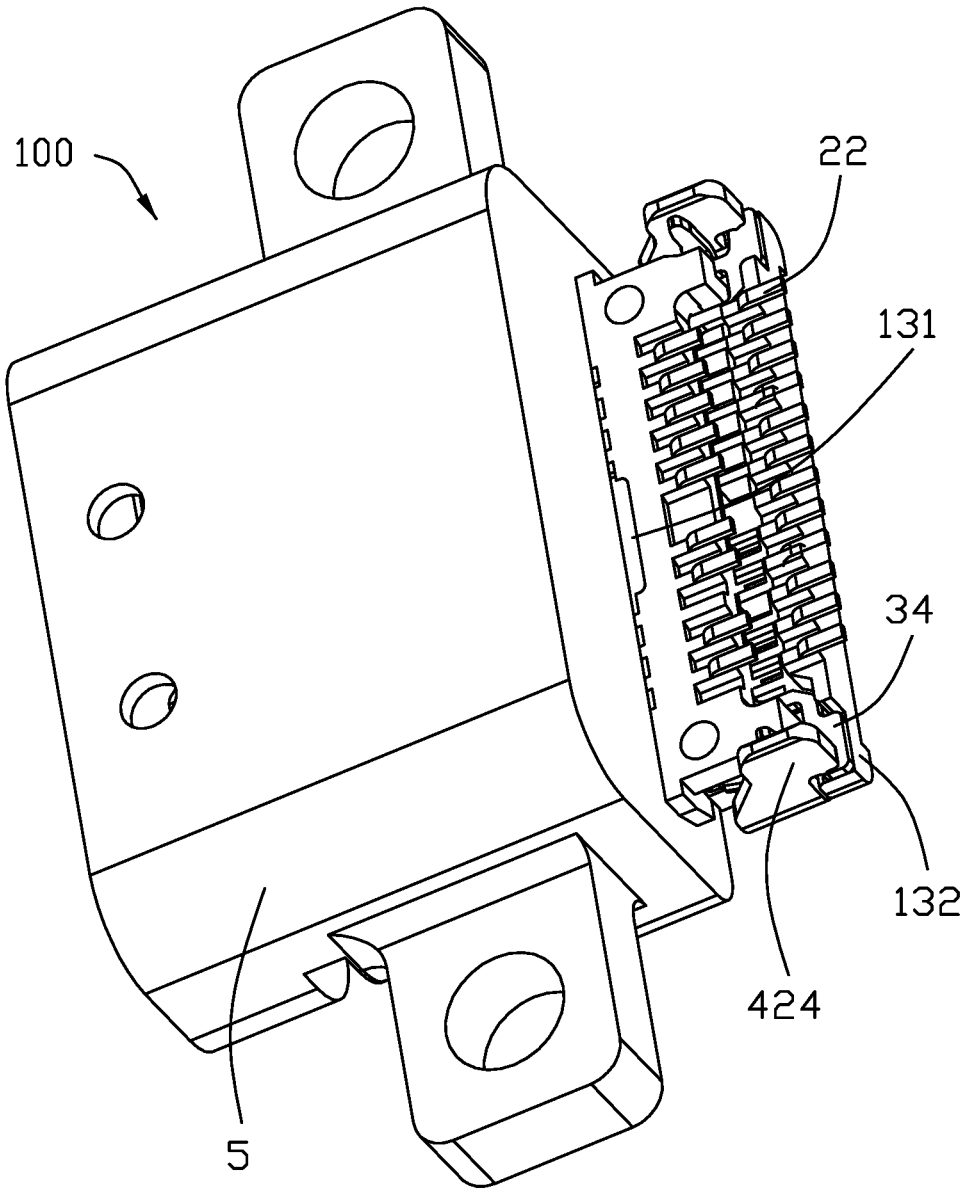
FIG. 3 is another perspective view of the electrical connector assembly.
Figure 14:
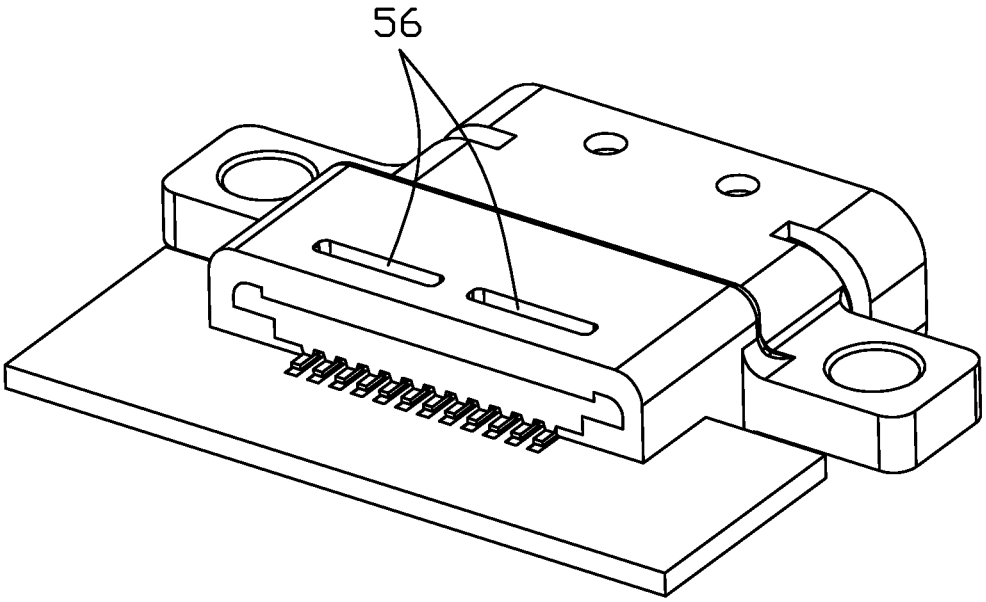
FIG. 14 is a perspective view of the electrical connector of another embodiment.

Subsequently the outer cover 5 is over-molded with the shielding shell 4 with a rear wall 57 unitarily formed with the fixing portion 53 to seal a rear (side) of the electrical connector 10 while exposing the rear extension 13 of the insulative housingl and the tails 22 of the contacts 2. Since the hole 421, the hole 35, and the hole 131 are in fluid communication, the fixing portion 53 of the outer cover 5 is formed therein. From a technical viewpoint, said fixing portion is essentially intersected and interengaged with the housing 1 and the contacts 2. In this embodiment, the rear wall 57 and the fixing portion 53 have corresponding stepped structure (FIG. 10) for enhancing the retention effect, The covering and positioning of the extension 42 of the shielding shell 4 over the rear extension 13 ensures coplanarity of the electrical connector 10. The provision of the stopping blocks 133 abutting against the shielding shell 4 and the peripheral ridge 111 prevents resin from flowing to the tongue 12 during molding process. In the first embodiment, as shown in FIG. 2 the rear part 52 of the outer cover 5 is terminated before reaching the through slots 425 for not blocking downward inspection of the solder tails of the lower row of contacts 2. Anyhow, in another embodiment, the rear part 52 may further rearwardly extend to flush with the rear end of the extension 42 as long as the corresponding inspection slots 56 (FIG. 14) is provided in vertical alignment with the corresponding through slots 425 for allowing the operator to downward inspect the solder tails of the lower row of contacts 2. In this embodiment, because the outer cover 5 extends rearward almost to reach the rear end of the whole connector, the whole connector is relatively rigid for resisting the forces during mating/un-mating. It is also noted that in the invention the shielding shell 4 is rearwardly assembled to the terminal module until the rear edge of the main body 41 abuts against the stopping block 133, and the notch 423 receives the corresponding corner portion 132 for preventing further rearward movement of the shielding shell 4 relative to the terminal module. Then, the tabs 426 (FIG. 5) are bent to the final position to forwardly abut against the rear side of the housing 1 for preventing forward movement of the shielding shell 4 relative to the housing 1. So the terminal module, i.e., the housing 1 and the corresponding contacts 2 and the metallic plate 3, and the shielding shell 4 are secured together without relative movement therebetween. In this embodiment, the housing includes a plurality of openings 137 in which the corresponding contacts 2 are at least partially exposed. The outer cover 5 will fill such openings 137 and at least partially wrap the corresponding contacts 2 in the openings 137.

What is claimed is:

1. An electrical connector assembly comprising:

an electrical connector including:

an insulative housing having a base, a front tongue in front of the base, and a rear extension behind the base;

upper and lower rows of contacts mounted in the insulative housing and exposed to the tongue, each of the upper and lower rows of contacts having a tail;

a metallic plate positioned between the upper and lower rows of contacts; and a shielding shell enclosing the insulative housing; and an insulative outer cover over-molding the shielding shell to seal a rear of the electrical connector while exposing the rear extension of the insulative housing and the tails of the contacts; wherein the base of the insulative housing includes a peripheral ridge interference fitted to the shielding shell, and the rear extension of the insulative housing includes four stopping blocks abutting the shielding shell.

2. The electrical connector assembly as claimed in claim 1, wherein the rear extension of the insulative housing has a first potting hole, the shielding shell includes an upper extension having a second potting hole in fluid communication with the first potting hole, and the outer cover forms a fixing portion in the first and second potting holes.

3. The electrical connector assembly as claimed in claim 2, wherein the metallic plate has a third potting hole in fluid communication with the first and second potting holes, and the fixing portion of the outer cover fills the third potting hole.

4. The electrical connector assembly as claimed in claim 1, wherein the rear extension of the insulative housing includes a pair of corner portions, the metallic plate has a pair of wing portions immediately below the pair of corner portions, and the shielding shell includes a pair of notches receiving the pair of corner portions and a pair of mounting portions bearing against the pair of wing portions.

5. An electrical connector assembly comprising:

an electrical connector including:

an insulative housing having a base, a front tongue extending forwardly from the base, and a rear extension extending rearwardly from the base;

upper and lower rows of contacts disposed in the housing;

a metallic shielding shell assembled to and enclosing the housing and having a tubular main body to define a mating cavity in which the front tongue extends forwardly, and an extension rearwardly extending from a rear end of the main body to cover, at least partially, the rear extension of the housing;

an insulative outer cover over-molded upon the electrical connector and including a rear part at least partially covering the extension of the shielding shell, said rear part further including a rear wall to cover a rear side of the housing; wherein the rear extension of the housing associated with tail sections of the contacts, extends rearwardly out of the rear wall for being exposed to an exterior for mounting to a printed circuit board.

6. The electrical connector assembly as claimed in claim 5, wherein the rear extension of the housing forms a plurality of openings in which the corresponding contacts are at least partially exposed, and said outer cover has a fixing portion filling said openings and intimately at least partially wrap the corresponding contacts in the openings.

7. The electrical connector assembly as claimed in claim 6, further including a metallic shielding plate embedded within the housing to divide the contacts into upper and lower rows, wherein said shielding plate includes a potting hole communicating with the openings, and the fixing portion of the outer cover occupies said potting hole.

8. The electrical connector assembly as claimed in claim 7, wherein said housing includes an upper body insert molded with the upper row of contacts, a rear body insert molded with the lower row of contacts, and a final body integrally formed with both the upper body and the lower body with the shielding plate therebetween via another insert-molding process to commonly form a terminal module, and wherein the final body forms a plurality of openings through which the final body extends.

9. The electrical connector assembly as claimed in claim 5, wherein said extension of the shielding shell forms a potting hole in which a fixing portion of the outer cover extends.

10. The electrical connector assembly as claimed in claim 5, wherein said rear extension of the housing forms a plurality of inspection holes in vertical alignment with solder tails of the corresponding contacts, and the shielding shell forms a corresponding inspection slot in vertical alignment with said inspection holes for inspection of said solder tails of the contacts.

11. The electrical connector assembly as claimed in claim 10, wherein said rear part extends rearwardly before reaching the inspection slot for not blocking inspection.

12. The electrical connector assembly as claimed in claim 5, wherein said outer cover further includes a pair of mounting ears with corresponding mounting holes therein, and wherein said mounting ears and the solder tails of the contacts are located at different levels.

13. An electrical connector assembly comprising:

an electrical connector including:

a terminal module having an insulative housing associated with a plurality of contacts therein, said housing including a front tongue and a rear extension with a base therebetween in a front-to-back direction;

a metallic shielding shell assembled upon the terminal module and including a tubular main body to enclose the front tongue, and an extension extending rearwardly from the main body to at least partially cover the rear extension; and an insulative outer cover over-molded and enclosing the electrical connector, said outer cover including a rear wall covering a rear side of the electrical connector while exposing the rear extension and solder tails of the contacts; wherein said outer cover further includes a fixing portion communicating with the rear wall and intersected with the terminal module.

14. The electrical connector assembly as claimed in claim 13, wherein the housing forms a plurality of openings with corresponding contacts exposed therein, and said fixing portion fills said openings.

15. The electrical connector assembly as claimed in claim 13, wherein said housing forms a plurality of inspection holes in vertical alignment with solder tails of the corresponding contacts, and the shielding shell forms an inspection slot in vertical alignment with the inspection holes.

16. The electrical connector assembly as claimed in claim 13, wherein said outer cover fully covers the main body of the shielding shell while exposing the extension of the shielding shell.

17. The electrical connector assembly as claimed in claim 13, wherein the shielding shell form a potting hole through which the fixing portion extends.

18. The electrical connector assembly as claimed in claim 13, wherein said outer cover further includes a pair of mounting ears with corresponding mounting holes therein, and said mounting ears and solder tails of the contacts are located at different levels in a vertical direction.

19. The electrical connector assembly as claimed in claim 13, wherein at least one of said fixing portion and said rear wall has a stepped structure.

* * * * *